US011006494B1

(12) United States Patent
Sikora

(10) Patent No.: US 11,006,494 B1
(45) **Date of Patent: *May 11, 2021**

(54) METHODS OF COLOR SELECTION IN MULTIPLE COLOR LED LAMPS

(71) Applicant: Tomar Electronics, Inc., Gilbert, AZ (US)

(72) Inventor: Scott T. Sikora, Gilbert, AZ (US)

(73) Assignee: Tomar Electronics, Inc., Gilbert, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/867,496

(22) Filed: May 5, 2020

Related U.S. Application Data

(63) Continuation of application No. 16/275,052, filed on Feb. 13, 2019, now Pat. No. 10,645,778.

(60) Provisional application No. 62/630,173, filed on Feb. 13, 2018.

(51) Int. Cl.
*H05B 45/20* (2020.01)

(52) U.S. Cl.
CPC ..... *H05B 45/20* (2020.01)

(58) Field of Classification Search
CPC ..... H05B 33/0809; H05B 33/0815; H05B 33/0845; H05B 33/0848; H05B 33/0857; H05B 45/20; H05B 45/31
USPC ..... 315/291, 297
See application file for complete search history.

(56) References Cited

U.S. PATENT DOCUMENTS

| | | | | |
|---|---|---|---|---|
| 9,052,067 | B2 | 6/2015 | van de Ven | |
| 9,101,028 | B2 * | 8/2015 | Isaacson | H05B 45/20 |
| 10,225,903 | B1 * | 3/2019 | Fernandez | H05B 45/50 |
| 10,674,585 | B1 * | 6/2020 | Liu | H05B 45/37 |
| 2002/0195945 | A1 * | 12/2002 | Gershen | H05B 39/105 315/55 |
| 2006/0187236 | A1 * | 8/2006 | Runnels | H05B 45/22 345/593 |
| 2008/0048582 | A1 * | 2/2008 | Robinson | H05B 45/37 315/291 |
| 2009/0045933 | A1 | 2/2009 | Smith et al. | |
| 2011/0216523 | A1 * | 9/2011 | Tong | F21K 9/60 362/84 |
| 2012/0043910 | A1 * | 2/2012 | Nagashima | F21V 3/02 315/294 |
| 2012/0068610 | A1 | 3/2012 | Bertram | |
| 2016/0057818 | A1 * | 2/2016 | Tsai | H05B 47/105 315/153 |
| 2016/0249430 | A1 * | 8/2016 | Hou | H05B 45/20 |
| 2017/0311407 | A1 * | 10/2017 | Chen | F21S 4/10 |

* cited by examiner

*Primary Examiner* — Tung X Le
(74) *Attorney, Agent, or Firm* — Booth Udall Fuller, PLC; Kenneth C. Booth

(57) ABSTRACT

A method of selecting a color in a multiple color LED lamp with only two external wires leading to the LED lamp. The LED lamp receives power and control signals through a power lead of the lamp. By detecting a power pulse sequence on the power lead in a first pattern, a microcontroller within the lamp controls the lamp to illuminate a first color. By detecting a power pulse sequence on the power lead in a second pattern, the microcontroller controls the lamp to illuminate a second color. The pattern detected indicates the desired color for the lamp to the microcontroller. Other patterns indicate other control instructions for the lamp.

19 Claims, 3 Drawing Sheets

METHODS OF COLOR SELECTION IN MULTIPLE COLOR LED LAMPS

CROSS REFERENCE TO RELATED APPLICATIONS

This application is a continuation application of U.S. application Ser. No. 16/275,052 entitled "Methods of Color Selection in Multiple Color LED Lamps" to Scott T. Sikora, filed on Feb. 13, 2019, which application claims priority to U.S. Provisional Application No. 62/630,173 entitled "Color Selection in Multiple Color LED Lamps" to Scott T. Sikora, filed on Feb. 13, 2018, the contents of which are hereby incorporated herein by reference in their entirety.

TECHNICAL FIELD

Aspects of this document relate generally to light emitting diode (LED) lighting systems that use multiple color LED lamps, and more particularly to improved LED lamp circuitry and methods of signaling to the improved LED lamp circuitry how and when to illuminate with a desired color.

BACKGROUND

In the conventional LED warning lamp market, the trend is toward lightbars containing light heads that can emit two or three or more colors. This is done so that in one mode the lights might be flashing red or blue and then in another mode they may switch to Amber or White. Dual- and even triple-color lamps are becoming common. This can get quite costly in lightbars with many lamps to control.

The standard way of implementing this is through lamps consisting of sets of LEDs of different colors behind an optical system designed for multiple LEDs. Most of these multicolor lamps then have many wires coming out of them (at least a common power wire and a wire for each color) and require a separate controller channel (like in a MOSFET or other power switch connected to the output of a microcontroller) for each color, doubling or tripling the number of channels required. A typical 48" police lightbar, for example, might have around 20 lamps and a controller with 26 channels. To make this a triple color bar would require triple the number of channels and wires in the harness, requiring a much larger controller and a harness with many more wires and connectors, and with many more contacts. Harnesses and connectors are sources of potential failure.

SUMMARY

According to one aspect, a method of selecting a color in a multiple color LED lamp may comprise receiving power through a single power lead of a multiple color LED lamp, detecting, through a microcontroller in the LED lamp, a first power pulse sequence on the single power lead in a first predetermined pattern, the first predetermined pattern corresponding to a first desired color, illuminating the LED lamp a first desired color in response to detecting the first predetermined pattern on the single power lead, detecting, through the microcontroller in the LED lamp, a second power pulse sequence on the single power lead in a second predetermined pattern, the second predetermined pattern corresponding to a second desired color, and illuminating the LED lamp a second desired color in response to detecting the second predetermined pattern on the single power lead.

According to another aspect, a method of selecting a color in a multiple color LED lamp may comprise receiving power through a single power lead of a multiple color LED lamp, detecting, through a microcontroller in the LED lamp, a first power pulse sequence on the power lead in a first predetermined pattern, the first predetermined pattern corresponding to a first desired color, illuminating the LED lamp a first desired color in response to detecting the first predetermined pattern on the power lead, detecting, through the microcontroller in the LED lamp, a second power pulse sequence on the power lead in a second predetermined pattern, the second predetermined pattern corresponding to a second desired color, and illuminating the LED lamp a second desired color in response to detecting the second predetermined pattern on the power lead.

Particular embodiments may comprise one or more of the following features. Receiving power may comprise receiving power for a predetermined amount of time. Storing at the LED lamp a portion of the power received and using the power to detect the first power pulse sequence. The first predetermined pattern and the second predetermined pattern may each be part of a plurality of predetermined patterns each corresponding to a different color of a plurality of colors the multiple color LED lamp is able to display. The multiple color LED lamp may include only two external wires coupled to the LED lamp.

According to another aspect, a method of selecting a color in a multiple color LED lamp may comprise powering a multiple color LED lamp through a power lead, transmitting a first power pulse sequence on the power lead in a first predetermined pattern, the first predetermined pattern corresponding to a first desired color, causing, through a microcontroller in the LED lamp, the LED lamp to illuminate a first desired color in response to the first predetermined pattern on the power lead, transmitting a second power pulse sequence on the power lead in a second predetermined pattern, the second predetermined pattern corresponding to a second desired color, and causing, through the microcontroller in the LED lamp, the LED lamp to illuminate a second desired color in response to the second predetermined pattern on the power lead.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112(f). Moreover, even if the provisions of 35 U.S.C. § 112(f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The inventions will hereinafter be described in conjunction with the appended drawings, where like designations denote like elements, and.

DETAILED DESCRIPTION

Figure 1:
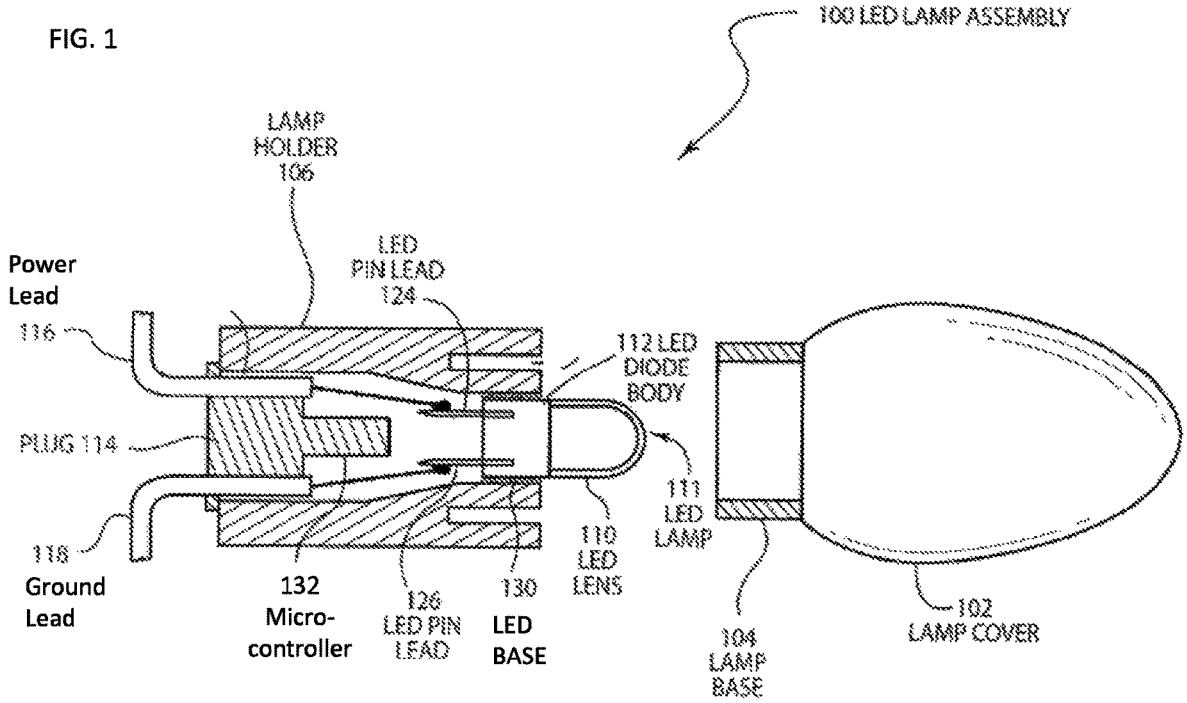
FIG. 1 is an illustration of a light emitting diode lamp.

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

With reference to FIG. 1, a multiple color light emitting diode (LED) lamp assembly 100 may comprise many different configurations depending upon the particular design implementation and lighting configuration needed for a particular LED lamp. In a simple, but versatile, example, a multiple color LED lamp may comprise three LEDs (one red, one green, one blue) within the lamp. White LEDs are also commonly included within an LED lamp. The LED lamp may comprise a lamp cover 102, a lamp base 104, a lamp holder 106, an LED lens 110, LED lamp 111, LED diode body 112, a plug 114, a power lead 116 and a ground lead 118, and in some implementations lead pin heads 124, 126 for each color within the LED diode body and a lead pin head 124, 126 for ground. In addition, a microcontroller 132 may be included within the LED lamp assembly 100, though the specific location of the microcontroller 132 is not critical. To eliminate the added cost of more wiring and to allow existing main controllers to be converted to multicolor operation with hardware redesign, the microcontroller 132 may be configured as an inexpensive microcontroller 132 added into the LED lamp 111 that is configured to detect and receive a power pulse pattern in the power lead 116 that indicates instructions for operation of the LED lamp. In particular, the power pulse pattern may indicate the desired color for illumination of the lamp.

Figure 2A:
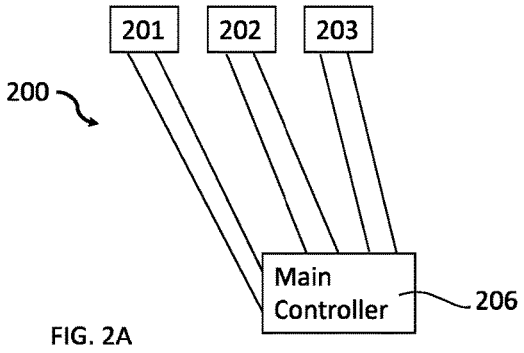
FIG. 2A-2B are system diagrams for a plurality of LED lamps coupled to a main controller.
Figure 2B:
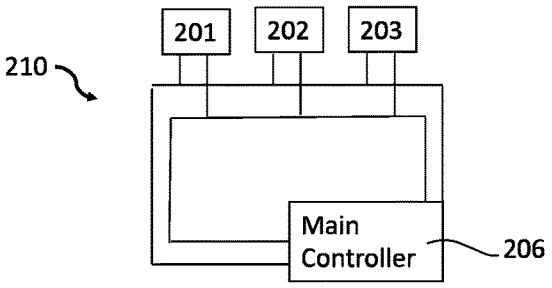

As illustrated in FIG. 2A, an LED lighting system 200 includes a plurality of LED lamps 201, 202, 203 each coupled to a main controller 206 by two lead lines 116, 118 (FIG. 1). The main controller 206 is configured to modulate the power to a particular LED lamp 201, 202, 203 to send a color select signal to the microcontroller 132 (FIG. 1) of the lamp 201, 202, 203. For example, if using a lamp 201, 202, 203 that can emit 4 colors, the main controller 206 firmware can be rewritten to pulse the power to a lamp a number of times or in a predetermined pattern to indicate what color to display. With this modification to controllers and lamp hardware, irrespective of the number of colors emitted, the lamp now only requires two wires, power 116 and ground 118, and any number of colors can be selected for illumination by the LED lamp 201, 202, 203. FIG. 2B illustrates an example of an LED lamp system 210 where the LED lamps 201, 202, 203 are coupled in parallel and the main controller 206 issues simultaneous and identical instructions to all LED lamps 201, 202, 203 at the same time. In particular implementations, the LED lamps 201, 202, 203 themselves may also be addressed and configured through the microcontroller 132 (FIG. 1) to recognize a modulated power pulse pattern specific to the identity of the particular LED lamp so that the LED lamp recognizes signals addressed specifically to the LED lamp.

Figure 3:
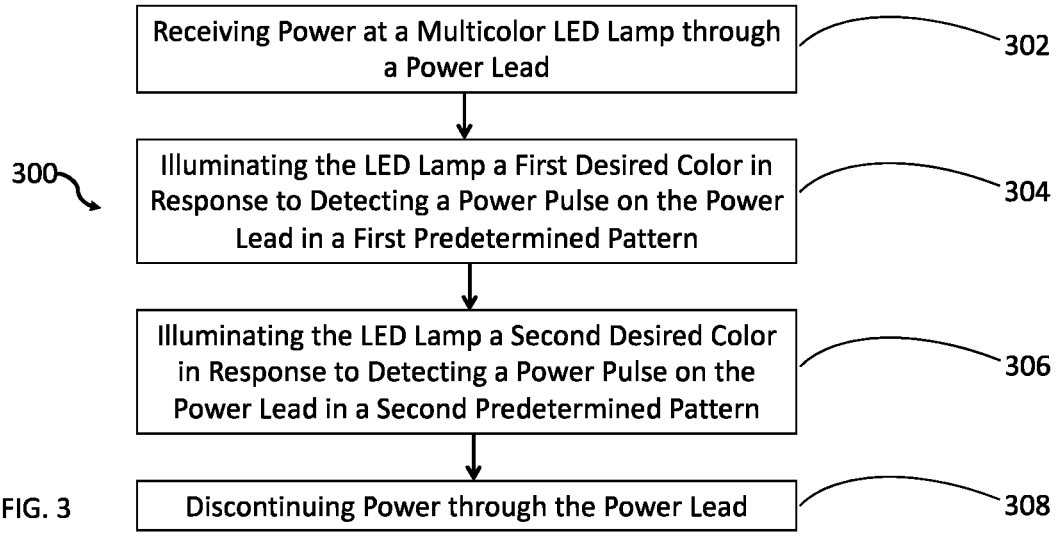
FIG. 3 is a flow chart of a method of selective illumination of an LED lamp with a desired color.

The following is one, non-limiting example of a method 300 of color selection in multiple color LED lamps, with reference to FIG. 3:

1) Apply power from the main controller to receive the power at a multicolor LED lamp (302) through the power lead. The application of the power may be for some predetermined amount of time for lamp microcontroller to start and store enough power to operate during receiving and detecting the control pulses. Storage of the power may be in a capacitor or other power storage device at the LED lamp.

2) The main controller delivers to the LED lamp through the power lead a power pulse in a first predetermined pattern and the LED lamp detects that pattern and illuminates the LED lamp in a first desired color in response to detecting the pattern (304). In particular implementations, the pulsing is fast enough not to be visible to the naked eye although the flicker could be incorporated as part of the warning signal. The number or pattern of pulses may indicate to the microcontroller of the lamp which color is to be displayed. The microcontroller includes enough intelligence to recognize the signal and pass the appropriate level of power to the appropriate LED input(s).

3) The main controller delivers to the LED lamp through the power lead a power pulse in a second predetermined pattern and the LED lamp detects that pattern and illuminates the LED lamp in a second desired color in response to detecting the pattern (306), changing the color of the lamp.

4) Lastly, the main controller may discontinue power through the power lead, or the microcontroller at the LED lamp may discontinue accepting power through the power lead (308) to turn off the LED lamp and stop illumination.

Using a simple multiple color LED lamp construction with only two wires required for each lamp and a microcontroller embodied in each lamp enables an LED lamp assembly, such as a lightbar and lightbar system, to be simple with the number of wires and controller channels no longer dependent on color count. This removes a large potential for failure of the lightbar.

Where the above examples, embodiments and implementations reference examples, it should be understood by those of ordinary skill in the art that other LED lamps and manufacturing methods and examples could be intermixed or substituted with those provided. In places where the description above refers to particular embodiments of LED lamps, controllers, microcontrollers and methods of operation, it should be readily apparent that a number of modifications may be made without departing from the spirit thereof and that these embodiments and implementations may be applied to other to LED lamp operation methods as well. Accordingly, the disclosed subject matter is intended to embrace all such alterations, modifications and variations that fall within the spirit and scope of the disclosure and the knowledge of one of ordinary skill in the art.

What is claimed is:

1. A method of selecting a color in a multiple color LED lamp, the method comprising:

receiving power from a main controller through a first power lead of a first multiple color LED lamp configured to emit light in each of at least two different colors of a first set of colors;

detecting, through a microcontroller in the first multiple color LED lamp, a first power pulse sequence on the first power lead from the main controller corresponding to selection of a first color from the first set of colors;

illuminating the first multiple color LED lamp the first color of the first set of colors in response to detecting the first power pulse sequence on the first power lead;

receiving power from the main controller through a second power lead of a second multiple color LED lamp configured to emit light in each of at least two different colors of a second set of colors;

detecting, through a microcontroller in the second multiple color LED lamp, a second power pulse sequence on the second power lead from the main controller corresponding to selection of a first color from the second set of colors; and illuminating the second multiple color LED lamp the first color of the second set of colors in response to detecting the second power pulse sequence on the second power lead.

2. The method of claim 1, further comprising:

detecting, through the microcontroller in the first multiple color LED lamp, a third power pulse sequence on the first power lead corresponding to selection of a second color from the first set of colors;

illuminating the first multiple color LED lamp the second color of the first set of colors in response to detecting the third power pulse sequence on the first power lead;

detecting, through the microcontroller in the second multiple color LED lamp, a fourth power pulse sequence on the second power lead corresponding to selection of a second color from the second set of colors; and illuminating the second multiple color LED lamp the second color of the second set of colors in response to detecting the fourth power pulse sequence on the second power lead.

3. The method of claim 1, wherein the first set of colors comprises the second set of colors.

4. The method of claim 1, further comprising storing at the first multiple color LED lamp a portion of the power received and using the stored power to detect the first power pulse sequence.

5. The method of claim 1, further comprising storing at the second multiple color LED lamp a portion of the power received and using the stored power to detect the second power pulse sequence.

6. A method of selecting a color in a multiple color LED lamp, the method comprising:

receiving power through a power lead of a multiple color LED lamp configured to emit light in each of at least two different colors;

detecting, through a microcontroller in the multiple color LED lamp, a first power pulse sequence on the power lead corresponding to selection of a first color of the at least two different colors;

illuminating the multiple color LED lamp the first color in response to detecting the first power pulse sequence on the power lead;

detecting, through the microcontroller in the multiple color LED lamp, a second power pulse sequence on the power lead corresponding to selection of a second color of the at least two different colors; and illuminating the multiple color LED lamp the second color in response to detecting the second power pulse sequence on the power lead.

7. The method of claim 6, wherein the power coming through the power lead comes from a main controller of a multiple color LED lamp assembly.

8. The method of claim 6, further comprising:

receiving power from a main controller through a second power lead of a second multiple color LED lamp configured to emit light in each of at least two different colors;

detecting, through a microcontroller in the second multiple color LED lamp, a third power pulse sequence on the second power lead from the main controller corresponding to selection of a third color of the at least two different colors; and illuminating the second multiple color LED lamp the third color of the at least two different colors in response to detecting the third power pulse sequence on the second power lead.

9. The method of claim 6, wherein the first power pulse sequence is a predetermined pattern corresponding to the first desired color.

10. The method of claim 6, wherein the first power pulse sequence is a predetermined number of pulses corresponding to the first desired color.

11. The method of claim 6, wherein the first power pulse sequence and the second power pulse sequence are each from among a plurality of power pulse sequences each corresponding to a different color of the at least two different colors the multiple color LED lamp is configured to display.

12. The method of claim 6, wherein receiving power comprises receiving power for a predetermined amount of time.

13. The method of claim 6, further comprising storing at the multiple color LED lamp a portion of the power received and using the stored power to detect the first power pulse sequence.

14. A method of selecting a color in a multiple color LED lamp, the method comprising:

receiving power through a first power lead of a multiple color LED lamp configured to emit light in each of at least two different colors;

detecting, through a microcontroller in the multiple color LED lamp, a first power pulse sequence on the first power lead corresponding to selection of a first color of the at least two different colors;

illuminating the multiple color LED lamp the first color in response to detecting the first power pulse sequence on the first power lead;

receiving power through a second power lead of a second multiple color LED lamp configured to emit light in each of at least two different colors;

detecting, through a microcontroller in the second multiple color LED lamp, a second power pulse sequence on the second power lead from the main controller corresponding to selection of a second color of the at least two different colors; and illuminating the second multiple color LED lamp the second color of the at least two different colors in response to detecting the second power pulse sequence on the second power lead.

15. The method of claim 14, wherein the power coming through the first power lead and the second power lead comes from a main controller of a multiple color LED lamp assembly.

16. The method of claim 14, wherein the first power pulse sequence is a predetermined pattern corresponding to the first desired color.

17. The method of claim 14, wherein the first power pulse sequence is a predetermined number of pulses corresponding to the first desired color.

18. The method of claim 14, wherein receiving power comprises receiving power for a predetermined amount of time.

19. The method of claim 14, further comprising storing at the multiple color LED lamp a portion of the power received and using the stored power to detect the first power pulse sequence.

* * * * *